United States Patent [19]

Teigen

[11] Patent Number: 4,577,593

[45] Date of Patent: Mar. 25, 1986

[54] WATERWALL TUBE ORIFICE MOUNTING ASSEMBLY

[75] Inventor: Bard C. Teigen, Enfield, Conn.

[73] Assignee: Combustion Engineering, Inc., Windsor, Conn.

[21] Appl. No.: 669,478

[22] Filed: Nov. 8, 1984

[51] Int. Cl.[4] ..... F22B 15/00; F22B 25/00; F22B 37/10

[52] U.S. Cl. ..... 122/235 D; 29/421 E

[58] Field of Search ..... 122/235 D, 235 C; 29/421 E

[56] References Cited

U.S. PATENT DOCUMENTS 1,988,659 1/1935 LaMont ..... 122/235 D
4,117,966 10/1978 Green et al. ..... 29/421 E
4,494,392 1/1985 Schroeder ..... 29/421 E

FOREIGN PATENT DOCUMENTS 156951 8/1932 Sweden ..... 122/235 D

*Primary Examiner*—Edward G. Favors
*Attorney, Agent, or Firm*—Robert L. Olson

[57] ABSTRACT

In a forced steam generator (10) having orifice assemblies (36) positioned in the inlet of each tube (28) lining the walls of the furnace (12). The orifice assemblies are explosively (46) expanded into each tube. In order to permit the tubes to be completely drainable even when located in a portion of a tube having a horizontal component thereto, the orifice (60) is located at the very bottom of the tube.

1 Claim, 4 Drawing Figures

FIG. 2
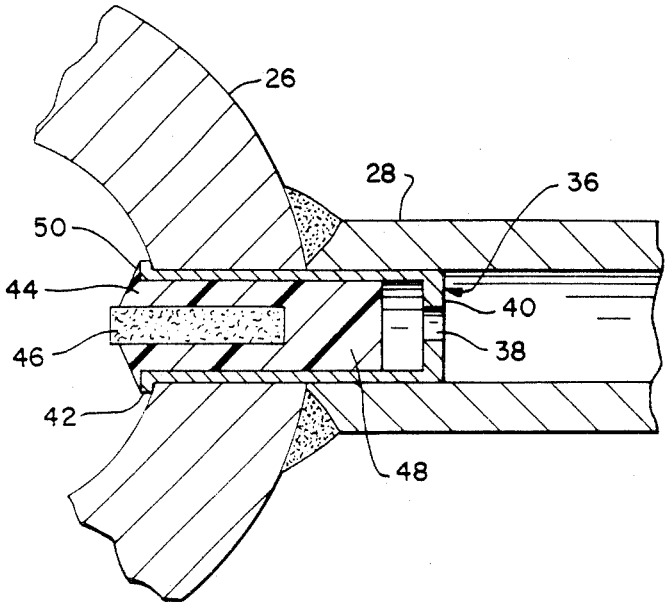
FIG. 3
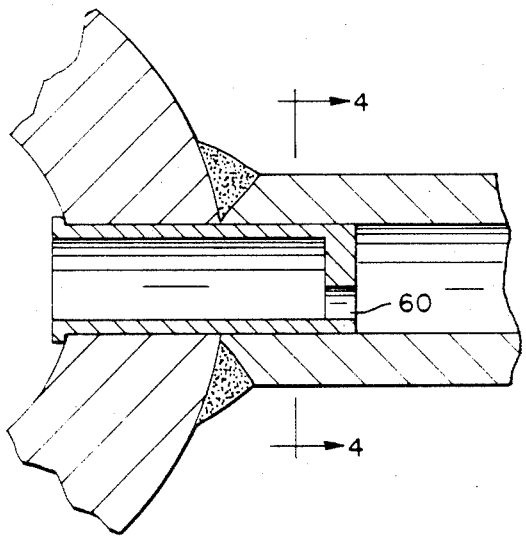
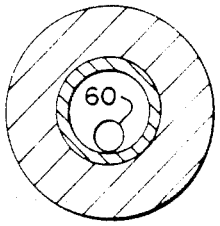
FIG. 4

WATERWALL TUBE ORIFICE MOUNTING ASSEMBLY

BACKGROUND OF THE INVENTION

The present invention relates to orifice assemblies for fluid flow conduits and more particularly to orifice assemblies for increasing the resistance to fluid flowing through such conduits. The present invention has particular application in forced circulation steam generating units. In steam generating units constructed to operate with forced circulation, a multiplicity of steam generating tubes are connected to a common header from which they receive their supply of water thereby forming a multiplicity of parallel tube circuits in which steam is generated. The common header is connected to the discharge of a pump which receives its water from a steam and water separating drum. The tube circuits discharge the steam and water mixture into the steam and water separating drum.

In the past, orifices or other flow restricting means have been employed at the entrance of each of the multiplicity of tubes for controlling the distribution of water from the common header to the individual tube circuits. A high flow resistance is required to assure uniform flow distribution and prevention of flow reversals in shaded water wall panels and flow starvation of adjacent tubes in the event of a single tube rupture. In connection with the latter aspect of flow starvation, the orifices serve to throttle or choke the flow to the ruptured steam generating tube. This then insures that the remaining mass flow from the common header will be distributed to the remaining, nonruptured steam generating tubes.

Present day means of securing the orifices into the tubes are as follows: First a ring is welded into the inner surface of each tube. Then a plate having a suitably sized orifice therein is mechanically clamped to the ring. This type of fastening has the advantage of being able to replace the orifice plate at a later date if it is determined that the wrong sized orifice has been placed in some of the tubes, or in the event the orifice plate becomes corroded to the point of being inoperative. This type of securing orifices in tubes also has some disadvantages. Because of the requirement of welding in the ring, it is an expensive procedure. Also because the ring and its associated orifice plate is located in a horizontal component of the tubes in many instances, it is not possible to completely drain the tubes during a shutdown period, or when the tubes are given an acid-wash. Also in high pressure steam generators, such as one operating at supercritical pressure, there can be considerable leakage of fluid between the orifice plate and the welded-in ring, making the orifice ineffective in accurately throttling the flow a desired amount.

SUMMARY OF THE INVENTION

According to the present invention, orifices are explosively expanded into the inlets of steam generating tubes, so as to form a fluid tight seal between the cup containing the orifice therein and the inner walls of the tube. Also, the orifice can be positioned at the bottom of the tube so that even when the orifice is located in a horizontal component of a tube it permits the tube to be completely self-drainable during shutdown or after an acid-washing of the tubes. By means of a heat shrinking procedure, the orifice can be easily removed from the tube if this becomes necessary.

BRIEF DESCRIPTION OF THE DRAWINGS

FIG. 2 is an enlarged partial sectional side view of a header showing one tube connection, and the manner in which its associated orifice assembly is secured in place;

FIG. 3 is a view similar to FIG. 2 showing an alternative orifice assembly; and

FIG. 4 is a view taken on line 4—4 of FIG. 3.

DESCRIPTION OF THE PREFERRED EMBODIMENT

Figure 1:
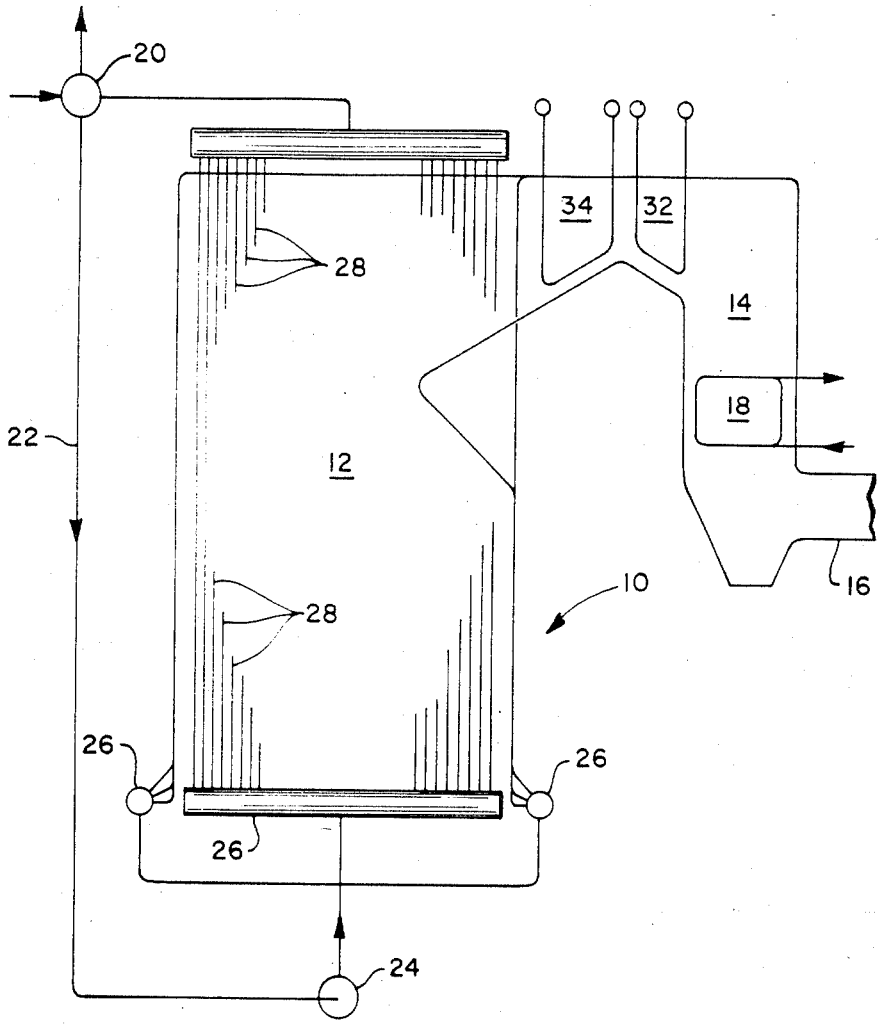
FIG. 1 is a schematic representation of a forced circulation steam generating unit in which the present invention is incorporated.

Referring now to FIG. 1, numeral 10 depicts a steam generating unit in its entirety. The unit has a furnace 12 into which fuel and air are introduced through burners (not shown). The hot combustion gases flow upwardly within the furnace 12 then downwardly through rear path 14 giving up heat along the way to the fluid passing through the various heat exchangers positioned therein, before being exhausted to the atmosphere through a stack connected to duct 16.

Water flows into and through an economizer 18 located in the rear path, then into the drum 20 down through pipe 22 to the pump 24. Water from the pump outlet flows to distribution headers 26, which supply the tubes 28, which are welded together to form the walls of the furnace chamber. The steam-water mixture leaving tubes 28 flows into the drum 20 with the water being separated therein and again flowing to the pump 24. The steam passes through superheaters 32, 34 before flowing to a steam turbine (not shown). The inlets of all the tubes 28 which line the furnace walls each contain an orifice assembly 36 (FIG. 2) to assure uniform flow of fluid to each of the tubes.

Looking now to FIG. 2, the details of one orifice assembly, and the manner in which it is securely installed, is shown. The orifice assembly 36 contains an orifice 38 located in an end wall 40. The opposite end is open and has a lip or flange 42 to initially accurately position the orifice plug during assembly. The assembly is of such outer diameter that it can be easily slid into the tube 28 from inside of header 26. Header 26 will either be of suitable size to permit workmen to climb inside, or it will be provided with handholes permitting ready access to the tube inlets. A polyethylene tube 44 is positioned inside the orifice assembly, which has a core within which is positioned an explosive 46. The polyethylene tube has a closed end 48 so that the residue from the explosion does not contaminate the interior of tube 28, and also to prevent distortion of the orifice 38. A flange 50 on the polyethylene tube 44 accurately positions it within the orifice assembly 36.

Any suitable detonating means can be used for detonating the charge and more than one explosive can be detonated at the same time. The explosive can be any of several suitable for this purpose. One such explosive is a Primacord fuse, preferably of PETN (pentaerythritol tetranitrate). Upon detonation, the polyethylene tube momentarily expands causing the orifice assembly 36 to expand into tight engagement with the inner wall of tube 28. The mechanical bond formed between the orifice 36 and the tube 28 is such that it prevents fluid leakage therebetween, even at extremely high pressures and temperatures. After an orifice assembly has been secured in the inlet of each tube 28 and the plastic tubes 44 removed, the header 26 can be closed and the unit will then be ready to be put into operation.

Looking now to FIGS. 3 and 4, an alternative form of the invention is shown. As mentioned earlier in the specification, it is desirable to be able to completely drain the boiler tubes 28 even when the orifice is contained in a part of the tube having a horizontal component. By making the opening 60 eccentric and by locating it in the very bottom of the tube 28, this is made possible. This is easily accomplished when the orifice assemblies are explosively secured in place in accordance with the invention.

If it becomes necessary to replace any of the orifice assemblies at a later time, such can be accomplished by inserting a heating element into the orifice assembly, and heating it to a temperature above the plastic deformation temperature of the assembly material. Upon cooling the assembly will shrink to less than its original size, allowing easy removal thereof. This process is described in U.S. application Ser. No. 584,703 filed on Feb. 29, 1984.

I claim:

1. In combination, a steam generator having a furnace, tubes lining the walls of the furnace, each tube having a portion having a horizontal component near its inlet end, header means for supplying fluid to the tubes, pump means for forcing fluid through the header means into the tubes, restriction means positioned in the inlet of each tube in the portion having a horizontal component for insuring adequate flow of fluid to each of the tubes, each restriction means comprising an orifice in a plate located within each tube, each orifice being located at the very bottom of the plate adjacent to the bottom of each tube, so that when the steam generator is shutdown, each tube is completely self-drainable by means of gravity and substantially no fluid is trapped on the upstream side of the restriction means.

* * * * *